US006048450A

United States Patent [19]

Mikitenko et al.

[11] Patent Number: 6,048,450

[45] **Date of Patent: *Apr. 11, 2000**

[54] PROCESS FOR THE SELECTIVE REDUCTION TO THE CONTENT OF BENZENE AND LIGHT UNSATURATED COMPOUNDS IN A HYDROCARBON CUT

[75] Inventors: Paul Mikitenko, Noisy Le Roy; Christine Travers, Rueil Malmaison; Jean Cosyns, Maule; Charles Cameron, Paris; Jean-Luc Nocca, Rueil Malmaison; Françoise Montecot, Les Clayes sous Bois, all of France

[73] Assignee: Institut Francais du Petrole, Rueil Malmaison Cedex, France

[ * ] Notice: This patent is subject to a terminal disclaimer.

[21] Appl. No.: 08/774,926

[22] Filed: Dec. 27, 1996

[30] Foreign Application Priority Data

Dec. 27, 1995 [FR] France ..... 95 15529

[51] Int. Cl.[7] ..... C10G 45/00

[52] U.S. Cl. ..... 208/143; 208/57; 208/144; 208/137; 585/253

[58] Field of Search ..... 208/57, 143, 144, 208/137; 585/253

[56] References Cited

U.S. PATENT DOCUMENTS

| | | | |
|---|---|---|---|
| 4,469,907 | 9/1984 | Araki et al. | 585/259 |
| 4,503,265 | 3/1985 | Schleppinghoff et al. | 568/697 |
| 4,648,959 | 3/1987 | Herber et al. | 208/89 |
| 4,847,430 | 7/1989 | Quang et al. | 568/697 |
| 4,960,960 | 10/1990 | Harrison et al. | 568/881 |
| 5,177,283 | 1/1993 | Ward | 585/446 |
| 5,368,691 | 11/1994 | Asselineau et al. | 203/29 |
| 5,773,670 | 6/1998 | Gildert et al. | 585/266 |
| 5,776,320 | 7/1998 | Marion et al. | 203/29 |
| 5,817,227 | 10/1998 | Mikitenko et al. | 208/143 |
| 5,830,345 | 11/1998 | Lee et al. | 208/92 |
| 5,856,602 | 1/1999 | Gildert et al. | 585/266 |
| 5,888,355 | 3/1999 | Mikitenko et al. | 203/DIG. 6 |

FOREIGN PATENT DOCUMENTS 0 552 070 7/1993 European Pat. Off. .

OTHER PUBLICATIONS

Benzene Reduction–Kerry Rock and Gary Gildert CDTECH—1994 Conference on Clean Air Act Implementation and Reformulated Gasoline—Oct. 1994.

*Primary Examiner*—Walter D. Griffin
*Assistant Examiner*—Nadine Preisch
*Attorney, Agent, or Firm*—Millen, White, Zelano & Branigan, P.C.

[57] ABSTRACT

A process for treating a feed comprising $C_5^+$ hydrocarbons and comprising at least one unsaturated $C_6^+$ compound including benzene, is such that the feed is treated in a distillation zone, associated with a hydrogenation zone, comprising at least one catalytic bed, in which the hydrogenation is carried out of unsaturated $C_6^+$ compounds contained in the feed, and whereof a charge for the hydrogenation step is removed at the height of a removal level and represents at least part of the liquid flowing in the distillation zone, and the effluent from the hydrogenation reaction zone is at least in part reintroduced into the distillation zone to ensure continuity of the distillation operation, the effluents at the top and bottom on the distillation zone being very depleted of unsaturated $C_6^+$ compounds. The effluent drawn off from the top of the distillation zone is treated in a zone for the isomerisation of $C_5$ and/or $C_6$ paraffins.

29 Claims, 4 Drawing Sheets

1
2
3
4
4a
4b
4c
4d
5
6
7
8
9
10
11
12
13
14
15
16
17
18
19
20
21
22
23
24

PROCESS FOR THE SELECTIVE REDUCTION TO THE CONTENT OF BENZENE AND LIGHT UNSATURATED COMPOUNDS IN A HYDROCARBON CUT

FIELD OF THE INVENTION

The invention is concerned with a process for the selective reduction in the content of light unsaturated compounds (that is to say containing at the most six carbon atoms per molecule) including benzene, in a hydrocarbon cut comprising mainly at least 5 carbon atoms per molecule, without any significant loss in the octane number, said process comprising passing said cut into a distillation zone associated with a hydrogenation reaction zone, followed by passing part of the effluent from the distillation zone comprising mainly $C_5$–$C_6$ hydrocarbons, that is to say containing 5 and/or 6 carbon atoms per molecule into a zone for the isomerisation of paraffins.

BACKGROUND OF THE INVENTION

In view of the acknowledged toxicity of benzene and olefins, unsaturated compounds, the general tendency is to reduce the content of these constituents in gasoline.

Benzene has carcinogenic properties, and it is therefore necessary to restrict to a maximum any possible pollution of the ambient air, in particular by excluding it in practice from automotive fuel. In the United States, reformulated fuels must contain no more than 1% benzene; in Europe, even though the requirements are not yet as strict, recommendations are gradually veering towards this value.

It has been acknowledged that olefins are among the most reactive hydrocarbons in the cycle of photochemical reactions with nitrogen oxides occurring in the atmosphere and resulting in ozone formation. An increase in the concentration of ozone in the air can be the cause of respiratory problems. It is therefore desirable to reduce the content of olefins in gasolines, and, more particularly, the content of lightest olefins which are most likely to become volatile when fuel is being processed.

The benzene content of a gasoline is very largely dependent on that of the reformate component of that gasoline. The reformate results from a naphtha catalytic treatment, the aim of which is to produce aromatic hydrocarbons comprising mainly from 6 to 9 carbon atoms in their molecule and whereof the very high index number imparts antiknock properties to the gasoline. As a result of the toxicity mentioned hereinabove, maximum reduction of the benzene content in the reformate is necessary. Several methods can be envisaged.

A first method consists in limiting the content of benzene precursors, such as cyclohexane and methylcyclopentane in the naphtha constituting the charge to a catalytic reforming unit. This solution is effective in permitting a substantial reduction of the benzene content in the effluent of the reforming unit but is not enough by itself when it is a question of reducing the content to as little as 1%. A second method consists in eliminating, by distillation, a light fraction from the reformate containing benzene. This solution results in a loss in the order of between 15 and 20% of the hydrocarbons which would be otherwise valorisable in gasolines. A third method consists in extracting the benzene present from the effluent of the reforming unit. Several known techniques are applicable in theory: solvent, extractive distillation, adsorption. None of these techniques is used on an industrial scale because none of them permits economical selective extraction of the benzene. A fourth method consists in the chemical conversion of the benzene into a constituent free from legal restrictions. Alkylation using ethylene converts the benzene mainly into ethylbenzene. However, this operation is tedious because of the intervention of secondary reactions which require separation operations which are costly in terms of energy.

The benzene in a reformate can also be hydrogenated into cyclohexane. Since selective hydrogenation of the benzene is impossible in a mixture of hydrocarbons which also contains toluene and xylenes, it is therefore necessary to first of all divide up that mixture in order to isolate a cut which contains only benzene and which can thus undergo hydrogenation. A process has also been described wherein the hydrogenation catalyst of the benzene is included in the stripping zone of the distillation column which separates the benzene from the other aromatics (Benzene Reduction—Kerry Rock and Gary Gildert CDTECH—1994 Conference on Clean Air Act Implementation and Reformulated Gasoline—October 1994.), which permits savings in respect of apparatus.

The hydrogenation of the benzene in a reformate results in a loss in the octane number. This loss in the octane number can be compensated for by adding compounds with a high octane number, e.g. ethers such as MTBE or ETBE, or branched paraffinic hydrocarbons. These branched paraffinic hydrocarbons can be generated by the reformate itself, by isomerisation of the linear paraffins. However, it is known that isomerisation catalysts of straight paraffins into branched paraffins are not inactive with respect to hydrocarbons of other chemical families. Of those which distill with benzene as a result of the azeotropic phenomenon, cyclohexane is converted partly into methylcyclopentane, for example. This reaction of naphthenic products competes on the catalyst with the isomerisation reaction of the paraffins and thus decreases its progress. On the other hand, isoparaffins with 7 carbon atoms per molecule undergo cracking which results firstly in gradual coking of the isomerisation catalyst and therefore in reduced activity and secondly in a reduction of the yield of the desired product, that is to say of the light reformate for inclusion in the gasoline.

SUMMARY OF THE INVENTION

The process according to the invention avoids the aforementioned drawbacks, that is to say it permits cost-effective production from a crude reformate or a reformate which has a depleted benzene content, or, if necessary, from which benzene has been almost completely removed as well as other unsaturated hydrocarbons containing at the most six carbon atoms per molecule, such as light olefins without any significant loss in yield, and with very little loss or with an increase to the octane number.

The process is characterised by the integration of three operations: distillation, hydrogenation and isomerisation operations which are arranged and carried out in such a way as to avoid at least partly, but preferably to a major extent, cyclohexane and isoparaffins with 7 carbon atoms per molecule from being entrained by the azeotropic effects of benzene into the distillate which is sent for isomerisation. Thus, the process according to the invention carries out, at least in part, the selective hydrogenation of benzene and, in addition, any unsaturated compound comprising at the most six carbon atoms per molecule which may be present in the charge.

The process according to the invention is a process for treating a charge of which the major part is constituted by hydrocarbons comprising at least 5, and preferably between 5 and 9, carbon atoms per molecule, and containing at least one unsaturated compound comprising at the most six carbon atoms per molecule including benzene, such that:

said charge is treated in a distillation zone, comprising a drainage zone and a stripping zone, associated with a hydrogenation reaction zone, comprising at least one catalytic bed in which the hydrogenation takes place of at least part of the unsaturated compounds comprising at the most six carbon atoms per molecule, that is to say comprising up to six (inclusive) carbon atoms per molecule, and contained in the charge, in the presence of a hydrogenation catalyst and a gaseous flow containing hydrogen, preferably a major part of hydrogen, the charge of the reaction zone being removed at the height of a removal level and representing at least a part, preferably the major part, of the liquid flowing into the distillation zone, preferably flowing into the stripping zone, and in such a way, still more preferably, that it flows at an intermediate level of the stripping zone, the effluent of the reaction zone being at least in part, preferably to a major extent, reintroduced into the distillation zone, in such a way as to ensure continuity of the distillation operation, and in such a way as to remove finally from the top of the distillation zone an effluent with a very depleted content of unsaturated compounds comprising at the most six carbon atoms per molecule, and at the bottom of the distillation zone an effluent also with a depleted content of unsaturated compounds comprising at the most six carbon atoms per molecule, at least a part, and preferably the major part, of the effluent which has been drawn off from the top of the distillation zone is treated in an isomerisation zone, said part including paraffins containing 5 and/or 6 carbon atoms per molecule (that is to say selected from the group formed by paraffins containing 5 carbon atoms per molecule and paraffins containing 6 carbon atoms per molecule), possibly in the presence of another cut containing paraffins whereof a major part contains 5 and/or 6 carbon atoms per molecule, in the presence of an isomerisation catalyst, in such a way as to obtain an isomerate.

The other cut comprising paraffins whereof a major part includes 5 and/or 6 carbon atoms per molecule, which may be present in the isomerisation charge with the part of the effluent drawn off from the top of the distillation zone comes from any source known to the skilled person. By way of example, a so-called light naphtha cut can be cited which has come from a naphtha fractionation unit.

The charge supplying the distillation zone is introduced into said zone usually at least at a level of said zone, preferably mainly at only one level of said zone.

The distillation zone usually comprises at least one column equipped with at least one internal distillation member selected from the group formed by panels, loose packing and structured packings, as known to the skilled person, such that the total overall efficiency is usually at least equal to five theoretical stages. In instances known to the skilled person where the use of one single column creates problems it is generally preferable to divide up said zone in such a way as to use, in the end, at least two columns, which, placed end-to-end, form said zone, that is to say that the stripping zones, which may be in the form of a reaction zone and drainage zone, are divided over the columns. Usually, when the reaction zone is at least partly inside the distillation zone, the stripping zone or drainage zone, and preferably the drainage zone, can usually be found in at least one different column of the column comprising the inner part of the reaction zone.

The hydrogenation reaction zone usually comprises at least one hydrogenation catalytic bed, preferably from 1 to 4 catalytic bed(s); if at least two catalytic beds are incorporated into the distillation zone, these two beds may be separated by at least one internal distillation member. The hydrogenation reaction zone performs at least partial hydrogenation of the benzene present in the charge, usually in such a way that the benzene content in the effluent at the top is at the most equal to a given content, and said reaction zone performs at least partial hydrogenation, and preferably hydrogenation to a major extent, of any unsaturated compound comprising at the most six carbon atoms per molecule and which is different from the benzene which may be present in the charge.

According to a first embodiment of the invention, the process according to the invention is such that the hydrogenation reaction zone is at least partly, preferably completely, inside the distillation zone. Thus, for the part of the reaction zone inside the distillation zone, liquid is removed naturally by flowing in the part of the reaction zone inside the distillation zone, and the effluent is reintroduced into the distillation zone naturally as well by the liquid flowing from the reaction zone inside the distillation zone in such a way as to ensure continuity of the distillation operation. Moreover, the process according to the invention is preferably such that the flow behaviour of the liquid for hydrogenation is co-current to the flow behaviour of the gaseous flow comprising hydrogen, for any catalytic bed in the inner part of the hydrogenation zone, and still more preferably the flow behaviour of the liquid for hydrogenation is co-current to the flow behaviour of the gaseous flow comprising hydrogen and such that the distillation vapour is separated from said liquid, for any catalytic bed in the inner part of the hydrogenation zone.

According to a second embodiment of the invention, independently of the above embodiment, the process according to the invention is such that the hydrogenation reaction zone is at least partly, preferably completely, outside the distillation zone. Thus, the effluent of at least one catalytic bed in the part outside the hydrogenation zone is reintroduced usually substantially in proximity to a removal level, preferably the removal level which has supplied said catalytic bed. Usually, the process according to the invention comprises between 1 and 4 removal level(s) which supplies/supply the part outside the hydrogenation zone. In this case, there are two possibilities. In the first instance, the part outside the hydrogenation zone is supplied by one single removal level, and then if said part comprises at least two catalytic beds distributed in at least two reactors said reactors are arranged in series or in parallel. In the second instance, which is the preferred instance according to the present invention, the part outside the hydrogenation zone is supplied by at least two removal levels.

According to a third embodiment of the invention which is a combination of the two embodiments described hereinabove, the process according to the invention is such that the hydrogenation zone is incorporated both partly in the distillation zone, that is to say inside the distillation zone, and partly outside the distillation zone. According to a preferred embodiment, the hydrogenation zone comprises at least two catalytic beds, at least one catalytic bed being inside the distillation zone, and at least one other catalytic bed being outside the distillation zone. If the part outside the hydrogenation zone comprises at least two catalytic beds, each catalytic bed is supplied via one single removal level, preferably associated with one single level where the effluent of said catalytic bed of the part outside the hydrogenation zone is reintroduced, said removal zone being separate from the removal level which supplies the other catalytic bed(s). Usually, the liquid for hydrogenation either partially or completely flows firstly around the part outside the hydrogenation zone and then around the part inside said zone. The part of the reaction zone inside the distillation zone has the features described with reference to the first embodiment. The part of the reaction zone outside the distillation zone has the features described with reference to the second embodiment.

According to another embodiment of the invention, independently or not of the previous embodiments, the process according to the invention is such that the flow behaviour of the liquid for hydrogenation is co-current or counter-current, preferably co-current, to the flow behaviour of the gaseous flow comprising hydrogen, for any catalytic bed in the hydrogenation zone.

In order to carry out hydrogenation according to the process of the invention, the theoretical molar ratio of hydrogen necessary to give the desired conversion of benzene is 3. The amount of hydrogen distributed, in the gaseous flow, upstream or in the hydrogenation zone may be excessive in relation to this stoichiometry, and this especially since in addition to the benzene present in the charge hydrogenation must be carried out at least partially of any unsaturated compound comprising at the most six carbon atoms per molecule and present in said charge. The excess hydrogen, if present, can advantageously be recovered, e.g. using one of the techniques to be described hereinafter. According to a first technique, the excess hydrogen issuing from the top of the distillation zone is recovered, then compressed and reused in the hydrogenation zone. According to a second technique, the excess hydrogen issuing from the top of the distillation zone is recovered, then compressed and reused in the isomerisation zone. According to a third technique, the excess hydrogen issuing from the top of the distillation zone is recovered, then injected upstream of the compression stages associated with a catalytic reforming unit, mixing with the hydrogen coming from said unit, said unit preferably operating at low pressure, that is to say usually at a pressure of less than 8 bar (1 bar=$10^5$ Pa).

The hydrogen used according to the invention for the hydrogenation of unsaturated compounds comprising at the most six carbon atoms per molecule, and contained in the gaseous flow, can come from any source producing hydrogen of at least 50% by volume purity, preferably of at least 80% by volume purity, and, still more preferably, of at least 90% by volume purity. By way of example, hydrogen can be cited which comes from catalytic reforming processes, methanation, P.S.A. (=pressure swing adsorption), electrochemical generation, steam cracking or steam reforming. It is also possible to envisage the hydrogen which is injected in the hydrogenation process passing first of all through the isomerisation step. In such a case, hydrogen is injected into the isomerisation unit in order to delay the deactivation of the isomerisation catalyst by carbon deposition. The hydrogen which is unconsumed in the isomerisation zone can then be purified and used in the hydrogenation unit.

One of the preferred embodiments of the process according to the invention, independently or not of the preceding realisations, is such that the effluent at the bottom of the distillation zone is mixed at least in part with the isomerisation effluent. The mixture thus obtained can, after possibly being stabilised, be used as fuel either directly or by being incorporated into fuel fractions.

Usually, it is preferable if the operating conditions are chosen wisely in relation to the type of charge and other parameters known to the person skilled in reactive distillation, such as the distillate/charge ratio, in such a way that the effluent at the top of the distillation zone is virtually free of cyclohexane and isoparaffins comprising 7 carbon atoms per molecule. Thus, the process according to the invention is usually and preferably such that the effluent at the top of the distillation zone is virtually free of cyclohexane and isoparaffins comprising 7 carbon atoms per molecule.

When the hydrogenation zone is at least partly incorporated into the distillation zone, the hydrogenation catalyst can be disposed in said incorporated part in accordance with the various technologies proposed in order to bring about catalytic distillation. They are mainly of two types.

According to the first type of technology, the reaction and distillation operations are carried out simultaneously in the same physical space, as taught for example in patent Application WO-A-90/02,603, U.S. Pat. Nos. 4,471,154, 4,475,005, 4,215,011, 4,307,254, 4,336,407, 4,439,350, 5,189,001, 5,266,546, 5,073,236, 5,215,011, 5,275,790, 5,338,517, 5,308,592, 5,236,663, 5,338,518, and also in the patents EP-B1-0,008,860, EP-B1-0,448,884, EP-B1-0,396,650 and EP-B1-0,494,550 and Patent Application EP-A1-0,559,511. The catalyst is thus usually in contact with a descending liquid phase, generated by the reflux introduced at the top of the distillation zone, and with an ascending vapour phase generated by the reboiling vapour introduced at the bottom of the zone. According to this type of technology, the gaseous flow comprising the hydrogen needed for the reaction zone, for carrying out the process of the invention could be joined to the vapour phase, substantially at the intake for at least one catalytic bed of the reaction zone.

According to the second type of technology, the catalyst is disposed in such a way that the reaction and distillation operations usually take place independently and consecutively, as taught in U.S. Pat. Nos. 4,847,430, 5,130,102 and 5,368,691, for example, the vapour from the distillation zone virtually not passing through any catalytic bed in the reaction zone. Thus, the process according to the invention is usually such that the flow behaviour of the liquid for hydrogenation is co-current to the flow behaviour of the gaseous flow comprising hydrogen and such that the distillation vapour is virtually not in contact with the catalyst (which is usually manifested by the fact that said vapour is separated from said liquid for hydrogenation), for any catalytic bed in the part inside the hydrogenation zone. In each case of this second type of technology, any catalytic bed in the part of the reaction zone inside the distillation zone is usually such that the gaseous flow containing hydrogen and the liquid flow which will react circulate in co-current manner, usually in ascending manner, through said bed, even if overall in the catalytic distillation zone the gaseous flow comprising hydrogen and the liquid flow which will react are flowing in counter-current manner. Such systems usually comprise at least one device for dispensing liquid which can, for example, be a liquid distributor, in any catalytic bed of the reaction zone. Nonetheless, since these technologies have been conceived for catalytic reactions between liquid reactants, they can only be suitable for a hydrogenation catalytic reaction if modified, wherein one of the reactants, namely hydrogen, is in the gaseous state. For any catalytic bed in the part inside the hydrogenation zone, it is therefore usually necessary to join a device for the distribution of the gaseous flow containing hydrogen, e.g. in accordance with one of the three techniques to be described hereinafter. Thus, the part inside the hydrogenation zone comprises at least one device for dispensing liquid and at least one device for dispensing the gaseous flow containing hydrogen, for any catalytic bed in the part inside the hydrogenation zone. According to a first technique, the device for dispensing the gaseous flow containing the hydrogen is disposed upstream of the device for dispensing liquid, and is thus disposed upstream of the catalytic bed. According to a second technique, the device for dispensing the gaseous flow containing the hydrogen is disposed at the level of the device for dispensing liquid, in such a way that the gaseous flow containing the hydrogen is introduced into the liquid upstream of the catalytic bed. According to a third technique, the device for dispensing the gaseous flow containing hydrogen is disposed downstream of the device for dispensing liquid, and therefore within the catalytic bed, preferably not far from said device for dispensing liquid in said catalytic bed. The terms, "upstream" and "downstream" which have been used hereinabove are to be understood in relation to the direction of flow of the liquid which will pass through the catalytic bed, that is to say usually in ascending manner.

One of the preferred embodiments of the process according to the invention is such that the catalyst in the part of the hydrogenation zone inside the distillation zone is disposed in the reaction zone in accordance with the base device described in the U.S. Pat. No. 5,368,691, arranged in such a way that any catalytic bed inside the distillation zone is supplied by a gaseous flow containing hydrogen, uniformly dispensed at the bottom thereof, e.g. in accordance with one of the three techniques described hereinabove. In accordance with this technology, if the distillation zone comprises only one column and if the hydrogenation zone is completely inside said column, the catalyst contained in any catalytic bed inside the distillation zone is thus in contact with an ascending liquid phase which has been generated by the reflux introduced at the top of the distillation column, and with the gaseous flow comprising hydrogen which circulates in the same direction as the liquid; contact with the vapour phase of the distillation operation is avoided by causing this latter to move through at least one specially arranged stack.

When the hydrogenation zone is at least partly inside the distillation zone, the operating conditions of the part of the hydrogenation zone inside the distillation zone are linked to the operating conditions for the distillation operation. Distillation is carried out in such a way that the basic product thereof contains the major part of the cyclohexane and isoparaffins with 7 carbon atoms of the charge, as well as the cyclohexane formed by hydrogenation of the benzene. It is carried out at a pressure which is usually between 2 and 20 bar, preferably between 4 and 10 bar (1 bar=$10^5$ Pa), with a reflux ratio of between 1 and 10, and preferably of between 3 and 6. The temperature at the top of the zone is usually between 40 and 180° C., and the temperature at the bottom of the zone is usually between 120 and 280° C. The hydrogenation reaction is carried out under conditions which are most frequently intermediate between those prevailing at the top and bottom of the distillation zone, at a temperature of between 100 and 200° C., and preferably of between 120 and 180° C., and at a pressure of between 2 and 20 bar, preferably of between 4 and 10 bar. The liquid which has been subjected to hydrogenation is supplied by a gaseous flow containing hydrogen, the throughput thereof being dependent on the concentration of benzene in said liquid, and, more generally, on the unsaturated compounds which comprise at the most six carbon atoms per molecule of charge in the distillation zone. It is usually at least equal to the throughput in accordance with the stoichiometry of the hydrogenation reactions involved (hydrogenation of benzene and of other unsaturated compounds comprising at the most six carbon atoms per molecule, contained in the hydrogenation charge), and at the most equal to the throughput corresponding to 10 times the stoichiometry, preferably to between 1 and 6 times the stoichiometry, and even more preferably to between 1 and 3 times the stoichiometry.

When the hydrogenation zone is partly outside the distillation zone, the catalyst arranged in said part outside is hydrogenated in accordance with any technology known to the skilled person under operating conditions (temperature, pressure . . . ) which are independent or not, preferably independent, of the operating conditions of the distillation zone.

In the part of the hydrogenation zone outside the distillation zone, the operating conditions are usually as follows. The pressure required for this hydrogenation stage is usually between 1 and 60 bars absolute, preferably between 2 and 50 bar, and still more preferably between 5 and 35 bar. The operating temperature in the part outside said hydrogenation zone is usually between 100 and 400° C., preferably between 120 and 350° C., and still more preferably between 140 and 320° C. The space velocity within the part outside said hydrogenation zone, calculated in relation to the catalyst, is usually between 1 and 50, and more particularly between 1 and 30 $h^{-1}$ (volume of charge per volume of catalyst and per hour). The throughput of hydrogen in accordance with the stoichiometry of the hydrogenation reactions involved is between 0.5 and 10 times said stoichiometry, preferably between 1 and 6 times said stoichiometry, and still more preferably between 1 and 3 times said stoichiometry. However, the temperature and pressure conditions within the scope of the present invention can also be between those prevailing at the top and bottom of the distillation zone.

More generally speaking, irrespective of the position of the hydrogenation zone in relation to the distillation zone, the catalyst used in the hydrogenation zone according to the process of the present invention usually comprises at least one metal selected from the group formed by nickel and platinum, used as it is or preferably deposited on a support. The metal must usually be in reduced form for at least 50% of its total weight. However, any other hydrogenation catalyst known to the skilled person can also be selected.

When platinum is used, the catalyst can advantageously contain at least one halogen in a proportion by weight in relation to the catalyst of between 0.2 and 2%. Preferably, chlorine or fluoride or a combination of the two is used in a proportion in relation to the total weight of catalyst of between 0.2 and 1.5%. If a catalyst is used which contains platinum, a catalyst is usually used such that the average size of the platinum crystallites is less than $60.10^{-10}$, preferably less than $20.10^{-10}$ m, and still more preferably less than $10.10^{-10}$ m. Moreover, the total amount of platinum in relation to the total weight of catalyst is generally between 0.1 and 1%, and preferably between 0.1 and 0.6%.

If nickel is used, the amount of nickel in relation to the total weight of catalyst is between 5 and 70%, more particularly between 10 and 70%, and preferably between 15 and 65%. Moreover, a catalyst is usually used such that the average size of the nickel crystallites is less than $100.10^{-10}$ m, preferably less than $80.10^{-10}$, and still more preferably less than $60.10^{-10}$ m.

The support is usually selected from the group formed by alumina, silica-aluminas, silica, zeolites, active carbon, clays, aluminous cements, oxides of rare earth metals and alkaline-earth oxides, on their own or mixed. It is preferable to use an alumina- or silica-based support with a specific surface area of between 30 and 300 $m^2/g$, preferably of between 90 and 260 $m^2/g$.

The isomerisation catalyst used in the isomerisation zone according to the present invention is usually of two types. However, any other isomerisation catalyst known to the skilled person can also be selected.

The first type of catalyst is alumina-based. Preferably, it comprises at least one metal from group VIII of the periodic classification of elements and a support comprising alumina. Preferably, it further comprises at least one halogen, preferably chlorine. Thus, a preferred catalyst according to the present invention comprises at least one group VIII metal deposited on a support constituted by alumina and/or alumina gamma, that is to say, for example, that said support is constituted by alumina eta and alumina gamma, the content of alumina eta being between 85 and 95% by weight in relation to the support, preferably between 88 and 92% by weight, and still more preferably between 89 and 91% by weight, the complement up to 100% by weight of the support being constituted by alumina gamma. However, the catalyst support can also be constituted essentially by alumina gamma, for example. The group VIII metal is preferably selected from the group formed by platinum, palladium and nickel.

The alumina eta which may be used in the present invention has a specific surface area which is usually between 400 and 600 $m^2/g$, and preferably between 420 and 550 $m^2/g$, and a total pore volume which is usually between 0.3 and 0.5 $cm^3/g$, and preferably between 0.35 and 0.45 $cm^3/g$.

The gamma alumina which may be used in the present invention usually has a specific surface area of between 150 and 300 $m^2/g$, and preferably of between 180 and 250 $m^2/g$, a total pore volume which is usually between 0.4 and 0.8 $cm^3/g$, and preferably between 0.45 and 0.7 $cm^3/g$.

The two types of alumina, when used mixed, are mixed and shaped in proportions defined by any technique known to the skilled person, e.g. by extrusion through a die, by pellet formation or pastille formation.

A second type of catalyst used in the isomerisation zone according to the process of the present invention is a zeolite-based catalyst, that is to say a catalyst comprising at least one group VIII metal and a zeolite. Various zeolites can be used for said catalyst; said zeolite is preferably selected from the group formed by omega mordenite or zeolite. It is preferable to usa a mordenite with a Si/Al (atomic) ratio of between 5 and 50, and preferably of between 5 and 30, a sodium content of less than 0.2%, and preferably of less than 0.1% (in relation to the weight of dry zeolite), a mesh volume V of the elementary mesh of between 2.78 and 2.73 $nm^3$, and preferably of between 2.77 and 2.74 $nm^3$, a benzene absorption capacity of above 5%, and preferably of above 8% (in relation to the weight of dry solid). The mordenite prepared in this way is then mixed with a matrix which is usually amorphous (alumina, silica alumina, kaolin . . . ), and shaped by any method known to the skilled person (extrusion, pellet formation, pastille formation). The mordenite content of the support thus obtained must be greater than 40% and preferably greater than 60% by weight.

It is also possible to use an Ω omega zeolite-based or mazzite-based catalyst. Said zeolite has a $SiO_2/Al_2O_3$ molar ratio of between 6.5 and 80, preferably of between 10 and 40, a content by weight of sodium of less than 0.2%, preferably of less than 0.1% in relation to the weight of dry zeolite. It usually has "a" and "c" crystalline parameters of less than or equal to 1.814 nm and 0.760 nm (1 nm=$10^{-9}$ m) respectively, preferably of between 1.814 and 1.794 nm and between 0.760 and 0.749 nm, respectively, a nitrogen adsorption capacity measured at 77 K at a partial pressure of 0.19 bar, greater than about 8% by weight, preferably greater than about 11% by weight. Its pore distribution is usually between 5 and 50% of the pore volume contained in the pores with a radius (measured in accordance with the BJH method) of between 1.5 and 1.4 nm, preferably of between 2.0 and 8.0 nm (mesopores). Generally speaking, its DX rate of crystallinity (measured in accordance with its X-ray diffractogramme) is more than 60%.

The zeolite support thus obtained has a specific surface area which is usually between 300 and 550 $m^2/g$ and preferably between 350 and 500 $m^2/g$, and a pore volume which is usually between 0.3 and 0.6 $cm^3/g$, and preferably between 0.35 and 0.5 $cm^3/g$.

Irrespective of the isomerisation catalyst support (alumina or zeolite), at least one hydrogenating group VIII metal, preferably selected from the group formed by platinum, palladium and nickel, is then deposited on this support, using any technique known to the skilled person, e.g. in the case of platinum by anionic exchange in the form of hexachloroplatinic acid when the support is alumina and by cationic exchange with tetramine platinum chloride when the support is a zeolite.

In the case of platinum or palladium, the content by weight is between 0.05 and 1%, and preferably between 0.1 and 0.6%. In the case of nickel, the content by weight is between 0.1 and 10%, and preferably between 0.2 and 5%.

The isomerisation catalyst thus prepared can be reduced in hydrogen. If the support is alumina-based, said catalyst is subjected to a halogenation treatment, preferably chlorination, using any halogenated compound, preferably chlorinated, known to the skilled person, such as carbon tetrachloride or perchloroethylene. The halogen content, preferably chlorine, of the final catalyst is preferably between 5 and 15% by weight, and preferably between 6 and 12% by weight. This halogenation treatment, preferably chlorination, of the catalyst can be carried out either directly in the unit prior to injection of the charge ("in-situ") or ex-situ. In such a case, it is also possible to carry out the halogenation treatment, preferably chlorination, before the reduction treatment of the catalyst in hydrogen.

The operating conditions used in the isomerisation zone are usually as described hereinafter, depending on the type of catalyst.

With the first type of catalyst, which is alumina-based, the temperature is usually between 80 and 300° C., and preferably between 100 and 200° C. The partial hydrogen pressure is between 0.1 and 70 bar, and preferably between 1 and 50 bar. The space velocity is between 0.2 and 10, preferably between 0.5 and 5, liters of liquid hydrocarbons per liter of catalyst and per hour. The molar ratio of hydrogen to hydrocarbons at the intake to the isomerisation zone is such that the molar ratio of hydrogen to hydrocarbons in the isomerate is greater than 0.06 and preferably between 0.06 and 10.

With the second type of catalyst which is zeolitic, the temperature is usually between 200 and 300° C., and preferably between 230 and 280° C., and the partial hydrogen pressure is between 0.1 and 70 bar, and preferably between 1 and 50 bar. The space velocity is usually between 0.5 and 10, preferably between 1 and 5 liters of liquid hydrocarbons per liter of catalyst and per hour. The molar ratio of hydrogen to hydrocarbons in the isomerate can vary greatly and is usually between 0.07 and 15, and preferably between 1 and 5.

DETAILED DESCRIPTION OF THE DRAWINGS

Figure 1:
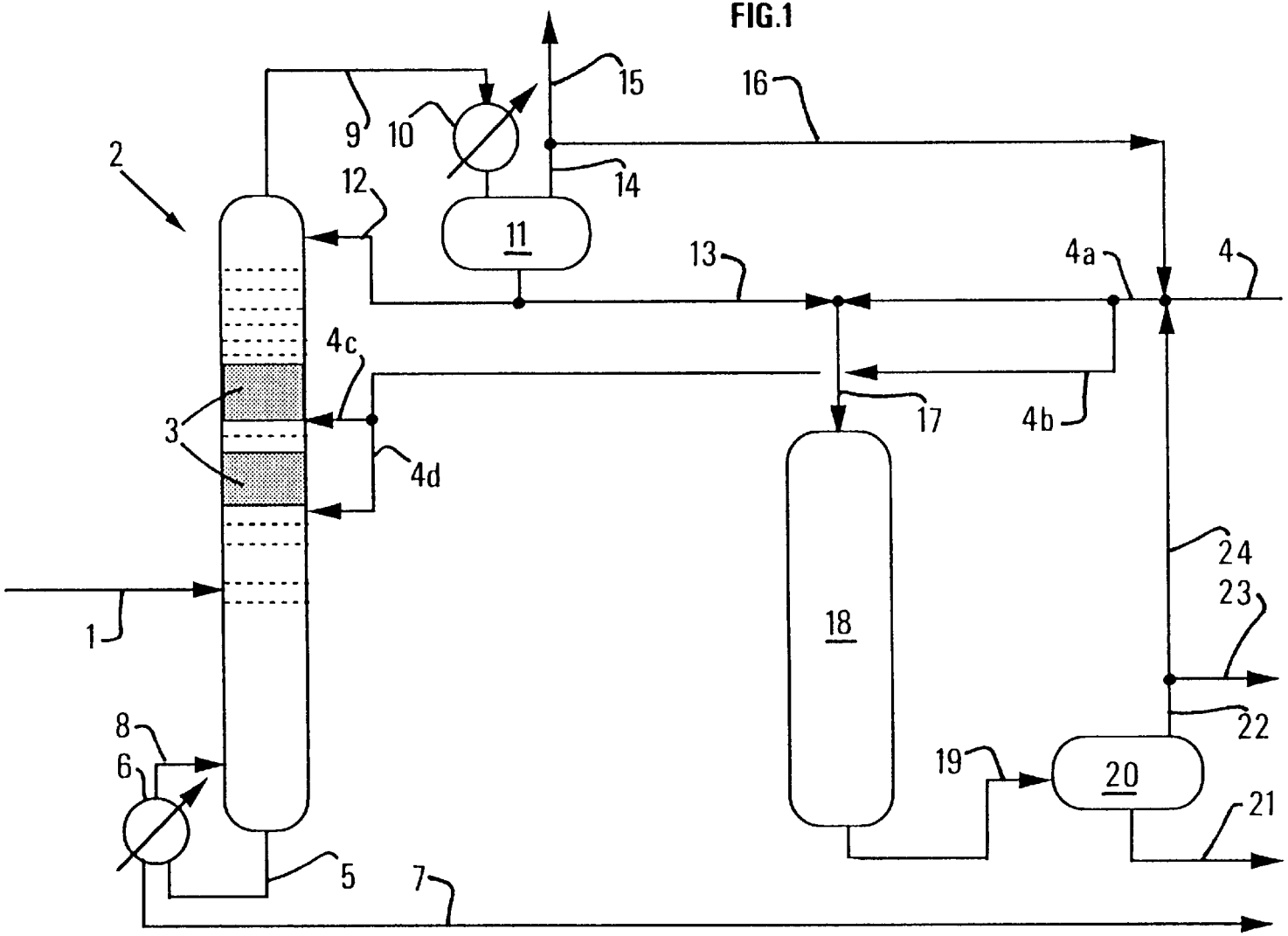
FIGS. 1 to 3 each is a schematic flowsheet of an embodiment of the process according to the invention with the same numerals being employed.

A first embodiment of the process is shown in FIG. 1. The crude $C_5^+$ reformate which usually contains small amounts of $C_4^+$ hydrocarbons is sent into a column 2 via a line 1. Said column contains internal distillation members, which, for example, in the case shown in FIG. 1, are in the form of plates or linings and are shown partly by way of dotted lines in that drawing. It also contains at least one internal catalytic member 3 which includes a hydrogenation catalyst which can be alternated with internal distillation members. The internal catalytic members are supplied at their base via lines 4*c* and 4*d* with hydrogen coming from lines 4, then 4*a* and 4*b*. At the foot of the column, the least volatile fraction of the reformate which is constituted mainly by hydrocarbons with 7 or more carbon atoms is recovered via line 5, reboiled in the exchanger 6 and removed via line 7. The reboiling vapour is reintroduced into the column via line 8. At the top of the column, the light hydrocarbon vapour, i.e. comprising mainly 6 carbon atoms or less per molecule is sent via line 9 to a condenser 10 and then into a spherical flask 11 where separation takes place between a liquid phase and a vapour phase constituted mainly by excess hydrogen which may be sent via lines 16 and then 4*a* and 4*b* and then 4*c* or 4*d*.

The vapour phase is removed from the spherical flask via lines 14 and then 15. A fraction is possibly recycled to the column via line 16, after having been placed back under pressure by using a device not shown in FIG. 1.

The liquid phase of the spherical flask 11 is sent back partly via line 12 at the top of the column in order to provide reflux. The other part is conveyed via lines 13 and then 17 to the isomerisation reactor 18. A hydrogen flow is possibly added via lines 4 and then 4*a*. The isomerate is recovered via line 19, cooled, and sent to a spherical flask 20 where a vapour phase constituted mainly by hydrogen is separated and removed via lines 22 and then 23, and possibly recycled after purification to the hydrogen circuit via line 24 and then via lines 4*a*, 4*b* and 4*c* or 4*d*.

The liquid phase is drawn off via line 21, and, after stabilisation if necessary, constitutes a component for gasolines which is almost free of unsaturated compounds comprising at the most 6 carbon atoms per molecule with a high octane number.

Figure 2:
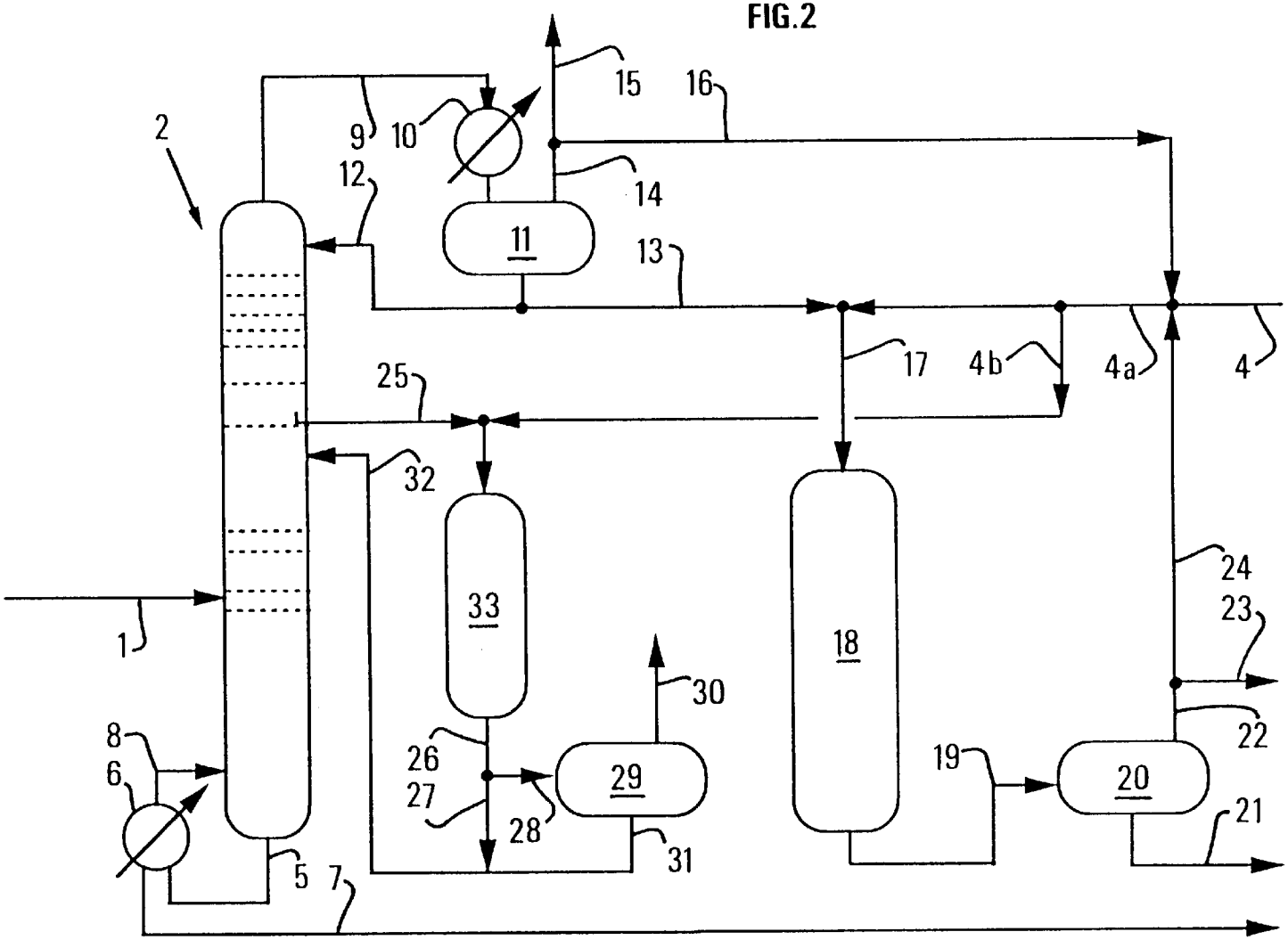

According to a second embodiment of the process, shown in FIG. 2, the crude $C_5^+$ reformate which usually contains small amounts of $C4^-$ hydrocarbons is sent via line 1 into a distillation column 2 equipped with internal distillation members, which, in the case of FIG. 2, may be distillation plates, and is also equipped with a draw-off plate (or removal plate) for the liquid phase. The liquid phase is drawn off from the removal plate via line 25 and is contacted with the hydrogen which has been conveyed via lines 4, 4*a* and 4*b*, and is directed to a hydrogenation reactor 33. The hydrogenation reactor can operate either with ascending flow or with descending flow, as indicated in FIG. 2. The effluent from this reactor is recovered via line 26 and is recycled to the distillation column via lines 27 and then 32, usually in the upper part of the distillation zone disposed under the removal plate in proximity to said plate. It is usually thought that a maximum of four hydrogenation reactors can constitute the hydrogenation zone if it is outside the distillation zone, irrespective of the number of removal level(s).

According to one variant of the process, all or part of the effluent of the reactor recovered via line 26 is cooled (exchanger not shown) and conveyed via line 28 to the spherical flask 29 where a vapour phase with a high content of hydrogen and which is removed via line 30 is separated from a liquid phase which is recycled to column 2 via lines 31 and 32. The effluents at the top and bottom of the column are treated in the way described hereinabove for the first embodiment of the process.

Figure 3:
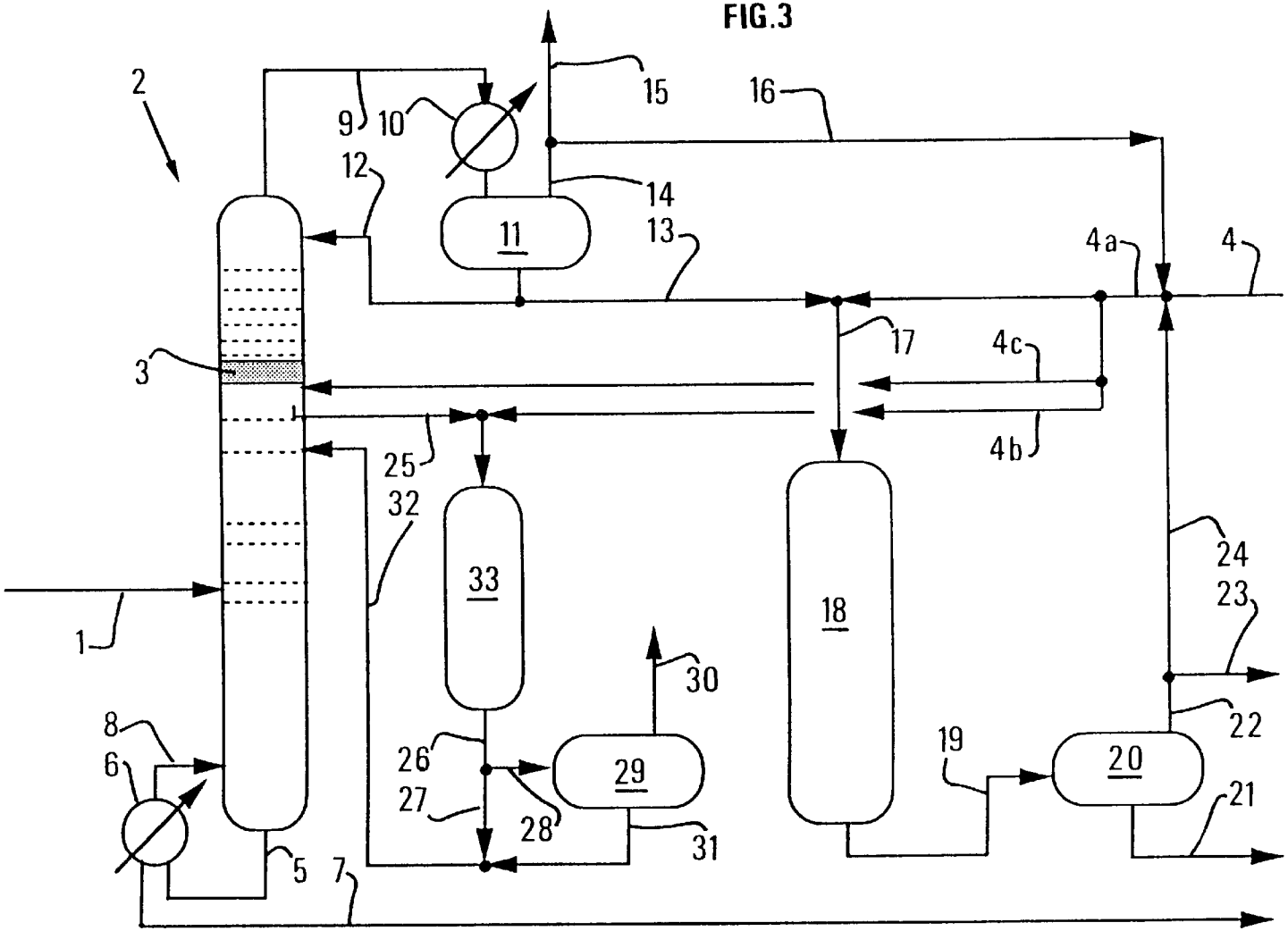

According to a third embodiment of the process, shown in FIG. 3, the hydrogenation zone is divided between a part inside the distillation column, as described for the first version of the process, and a part outside that column, as described for the second version of the process.

EXAMPLES

The following examples illustrate the invention for the particular case shown in FIG. 1.

Example 1

Figure 4:
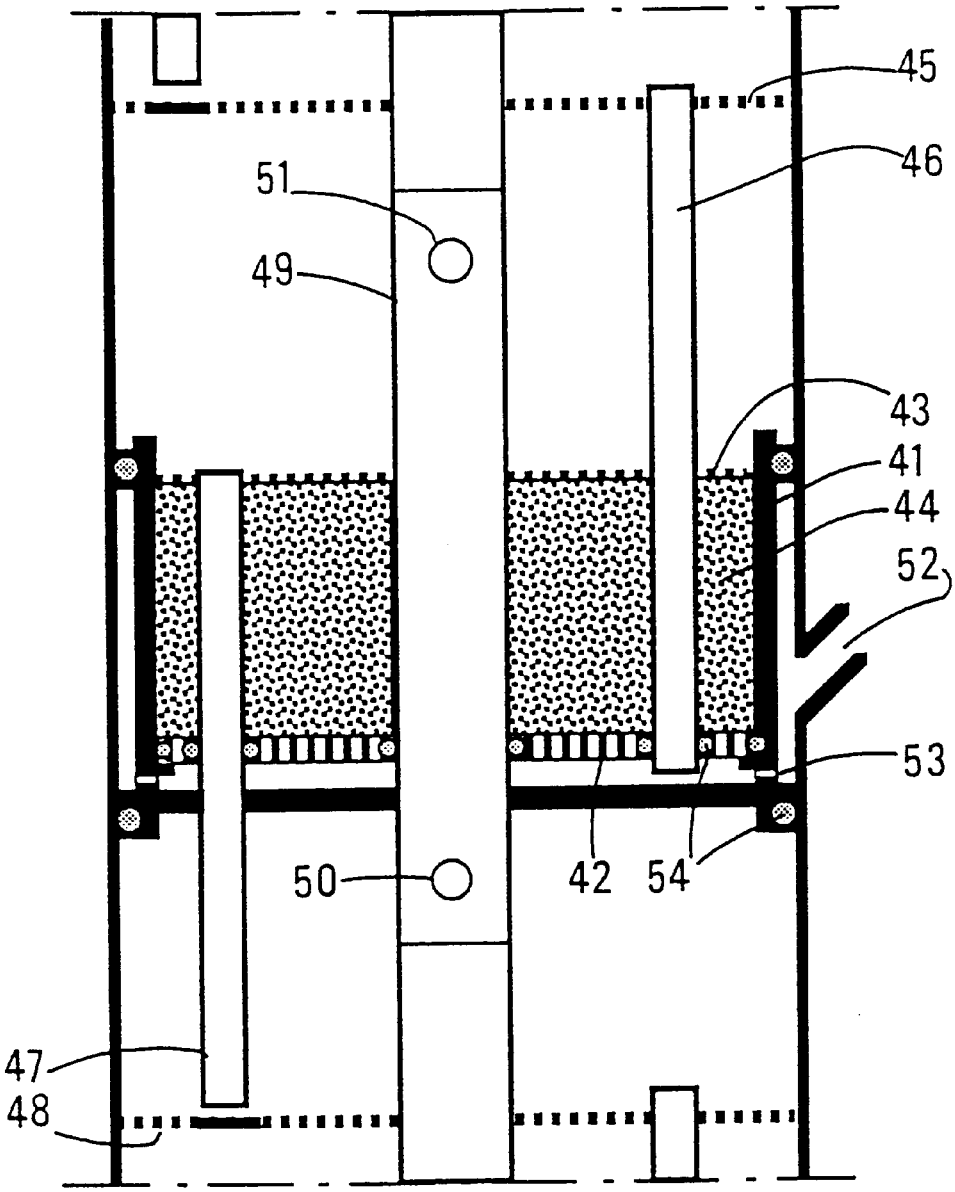
FIG. 4 is a schematic cross section of a catalytic cell arranged in the column and is further described in Example 1.

A metal distillation column is used of diameter 50 mm, which has been rendered adiabatic by heating casings with temperatures controlled in such a way as to reproduce the temperature gradient which prevails in the column. Over a height of 4.5 m, the column comprises from the top to the bottom: a stripping zone composed of 11 plates which are apertured with outlets and downcomers, a hydrogenating catalytic distillation zone and a drainage zone composed of 63 apertured plates. The hydrogenating catalytic distillation zone is constituted by three catalytic distillation pairs, each pair being itself constituted by a catalytic cell surmounted by three apertured plates. The detailed structure of a catalytic cell as well as its arrangement in the column are illustrated by way of example in FIG. 4. The catalytic cell 41 consists of a cylindrical container with a flat bottom of external diameter less than 2 mm the smaller diameter of the column. It is equipped at the bottom part thereof, above the bottom, with a grid 42 which serves both as a support for the catalyst and as a liquid distributor for the hydrogen, and at the upper part thereof it is equipped with a grid for retaining the catalyst 43, the height of which can be varied. The catalyst 44 fills the entire volume between the two grids. The catalytic cell receives the liquid coming from the upper distillation plate 45 via the downcomer 46. After having passed through the cell in the ascending direction, the liquid is removed by flowing over the downcomer 47, and it flows over the lower distillation plate 48. The vapour issuing from the bottom plate 48 takes the central stack 49 which is fixed to the cell, penetrating through orifices 50 (only one appears in the drawing), and re-emerging from it under the upper plate 45 through orifices 51 (only one appears in the drawing). The hydrogen is introduced at the foot of the catalytic cell via the tubing 52, then via the orifices 53 (six in total) which are distributed over the periphery of the cell, in the immediate vicinity of the base. Sealing joints 54 prevent any hydrogen escaping before it arrives on the catalytic bed.

Each one of the three cells is lined with 36 g of nickel catalyst sold by the company PROCATALYSE under reference LD 746. 250 g/h of a reformate constituted mainly by hydrocarbons with at least 5 carbon atoms in their molecule is introduced onto the 37th plate of the column, starting from the bottom, the composition of which reformate is shown in the second column of Table I. At the bottom of each cell a throughput of 4.5 Nl/h hydrogen is also introduced. The column is regulated by establishing a reflux ratio which is equal to 5 and by controlling the base temperature to 195° C. and the absolute pressure to 6 bar.

Under stabilised conditions, a residue and a distillate are collected with respective throughputs of 181 g/h and 69 g/h, the compositions of said residue and distillate being given in the third and fourth columns of Table I.

The distillate is sent together with the hydrogen, with a molar ratio of hydrogen to hydrocarbons fixed at 0.125, into an isomerisation reactor containing 57 g of a catalyst with a base of platinum on chlorinated alumina, sold by the company PROCATALYSE under the reference IS612A, operating at a temperature of 150° C. and a pressure of 30 bar. The effluent from the isomerisation reactor or isomerate has the composition shown in the last column of Table I.

The last three lines of Table I show the octane numbers RON (Research), MON (Engine) and (RON+MON)/2 (Average Octane Number) of the reformate, of the effluents in the column, and of the isomerate. The isomerate has an octane number which is 3 points more than the distillate, and can be valorised as a fuel component, provided that it is stabilised, that is to say by the removable by distillation of the 3% of very volatile constituents ($C_3^-$) formed during isomerisation, mainly by the decomposition of isoparaffins with 7 carbon atoms per molecule. By mixing the residue of the distillation operation with the isomerate which has stabilised, a gasoline is reconstituted which is almost free of benzene and olefins with an average octane number of 90.3. In comparison with the initial reformate, the reconstituted gasoline therefore has an average octane number of 0.3 points and is produced with a yield loss of 0.8 points.

TABLE 1 compositions (% by weight) and octane numbers of the various flows for Example 1

| | Reformate | Residue | Distillate | Isomerate |
|---|---|---|---|---|
| C6⁻ Hydrocarbons of which: | 26.4 | 0.20 | 94.9 | 97.9 |
| C3- | — | — | — | 3.0 |
| olefins | 0.19 | — | — | — |
| benzene | 4.70 | — | 0.48 | — |
| cyclohexane | 0.08 | 0.19 | 16.3 | 6.85 |
| C7 + hydrocarbons of which: | 73.6 | 99.8 | 5.1 | 2.1 |
| isoC7 | 9.47 | 11.1 | 5.1 | 2.1 |
| toluene | 19.7 | 27.2 | — | — |
| xylene | 20.1 | 27.7 | — | — |
| Total | 100 | 100 | 100 | 100 |
| RON | 95.5 | 100.1 | 77.6 | 80.5 |
| MON | 85.8 | 89.1 | 74.5 | 77.8 |
| RON + MON)/2 | 90.6 | 94.6 | 76.1 | 79.1 |

Example 2

The steps carried out in Example 1 are repeated, using the same apparatus, the same hydrogenation catalysts and isomerisation catalysts, and the same operating conditions, except as far as the distillation column is concerned wherein the basic temperature is controlled to a reference value fixed at 188° C. In this way, the effluent at the top of the distillation zone is virtually free of cyclohexane and isoparaffins with 7 carbon atoms per molecule.

At the bottom and top of the distillation column, a residue and a distillate are collected respectively with throughputs of 195.7 and 54.2 g/h, the compositions and octane numbers of which are given in the third and fourth columns of Table 2. The last column of the table gives the composition and octane numbers of the isomerate.

In comparison with Example 1, the cyclohexane content of the distillate is much lower and the content of isoparaffins with 7 carbon atoms per molecule is very low. Isomerisation thereof reveals an average octane number of more than 10 points which is virtually without loss in the form of very volatile products (C3⁻). By mixing the isomerate with the distillation residue a reconstituted petrol is obtained which is almost free of benzene and olefins, with an average octane number of 90.8, that is to say significantly above that of the initial reformate, and without any significant loss in yield.

TABLE 2 compositions (% by weight) and octane numbers of the various flows for Example 2

| | Reformate | Residue | Distillate | Isomerate |
|---|---|---|---|---|
| C6⁻ Hydrocarbons of which: | 26.4 | 6.1 | 99.9 | 99.9 |
| C3- | — | — | — | 0.08 |
| Olefins | 0.19 | — | — | — |
| Benzerie | 4.70 | 0.01 | 0.54 | — |
| Cyclohexane | 0.08 | 5.83 | 0.43 | 1.27 |
| C7 + Hydrocarbons of which: | 73.6 | 93.9 | 0.18 | 0.1 |
| isoC7 | 9.47 | 12.1 | 0.18 | 0.1 |
| toluene | 19.7 | 25.2 | — | — |
| xylene | 20.1 | 25.6 | — | — |
| Total | 100 | 100 | 100 | 100 |
| RON | 95.5 | 98.5 | 72.5 | 83.3 |
| MON | 85.8 | 87.6 | 71.6 | 82.3 |
| (RON + MON)/2 | 90.6 | 93.1 | 72.1 | 82.8 |

We claim:

1. A process for treating a feed of which the major part is constituted by hydrocarbons comprising at least 5 carbon atoms per molecule and containing at least one unsaturated compound comprising at the most six carbon atoms per molecule including benzene, and a minor part containing $C_7^+$ isoparaffins comprising:

a) treating said feed in a distillation zone, said distillation zone being in communication with a hydrogenation reaction zone, wherein the distillation zone is a distillation column and said hydrogenation zone is at least partly outside of the distillation column.

b) removing from the distillation zone a charge for the hydrogenation reaction zone at a removal level of the distillation zone and representing at least part of the liquid flowing into the distillation zone, c) hydrogenating, in said hydrogenation reaction zone comprising at least one catalytic bed, at least part of the unsaturated compounds comprising at the most six carbon atoms per molecule including benzene contained in the charge, in the presence of a hydrogenation catalyst and a gaseous flow containing hydrogen, to produce a hydrogenation effluent containing cyclohexane, d) reintroducing at least part of the hydrogenation effluent from the hydrogenation reaction zone into the distillation zone, in such a way as to ensure continuity of the distillation, e) removing from the top of the distillation zone an overhead effluent with a depleted content of cyclohexane and $C_7^+$ isoparaffins and said at least one unsaturated compounds comprising at the most six carbon atoms per molecule, and at the bottom of the distillation zone a bottom effluent with a depleted content of said at least one unsaturated compound comprising at the most six carbon atoms per molecule, and (f) treating at least a part of the overhead effluent drawn off from the top of the distillation zone selectively in an isomerisation zone, said part of the effluent comprising paraffins containing at least 5 carbon atoms per molecule in the presence of an isomerisation catalyst, to obtain an isomerate containing an increased concentration of branched hydrocarbons.

2. A process according to claim 1, wherein the distillation is carried out at a pressure of between 2 and 20 bar, with a reflux ratio of between 1 and 10, the temperature at the top of the distillation zone being between 40 and 180° C. and the temperature at the bottom of the distillation zone being between 120 and 280° C.

3. A process according to claim 1, wherein the distillation zone is in a distillation column and the hydrogenation reaction zone is at least partly inside the distillation column.

4. A process according to claim 3, wherein in to the part of the hydrogenation reaction zone inside the distillation zone, the hydrogenation reaction is carried out at a temperature of between 100 and 200° C., at a pressure of between 2 and 20 bar, and the throughput of hydrogen supplying the hydrogenation zone is between one and 10 times the throughput in accordance with the stoichiometry of the hydrogenation reactions involved.

5. A process according to claim 1, wherein in the part of the hydrogenation reaction zone outside the distillation column, the hydrogenation is conducted at between 1 and 60 bar, the temperature is between 100 and 400° C., the space velocity within the hydrogenation zone, calculated in relation to the catalyst, is between 1 and 50 volume of charge per volume of catalyst and per hour, and the hydrogen throughput is between 0.5 and 10 times the stoichiometric quantity of hydrogen required for the hydrogenation reactions involved.

6. A process according to claim 3, wherein a catalytic bed containing hydrogenation catalyst is disposed in the hydrogenation zone inside the distillation zone and the hydrogenation catalyst is in contact with a descending liquid phase and with an ascending vapour phase.

7. A process according to claim 6, wherein the hydrogen for the hydrogenation zone is introduced at, substantially the intake of at least one catalytic bed of the hydrogenation zone.

8. A process according to claim 1, wherein a catalytic bed containing a hydrogenation catalyst is also disposed inside the distillation zone, and the flow behaviour of the liquid for hydrogenation is co-current to the flow behaviour of the gaseous flow comprising the hydrogen.

9. A process according to claim 3, wherein a catalytic bed containing hydrogenation catalyst is also disposed inside the distillation zone, the flow behaviour of the liquid for hydrogenation is co-current to the flow behaviour of the gaseous flow comprising hydrogen and the distillation vapour is out of contact with the catalyst.

10. A process according to claim 9, wherein liquid is introduced into the hydrogenation zone in a catalytic bed in said hydrogenation zone and a gaseous flow comprising hydrogen is dispersed into said catalytic bed.

11. A process according to claim 10, wherein the gaseous flow comprising hydrogen is dispersed into said catalytic bed upstream of where liquid is introduced.

12. A process according to claim 10, wherein the gaseous flow comprising hydrogen is dispersed at a level where liquid is introduced.

13. A process according to claim 10, wherein the gaseous flow comprising hydrogen is dispersed downstream of where the liquid is introduced.

14. A process according to claim 1, wherein the bottom effluent is withdrawn at the bottom of the distillation zone and is mixed at least partly with the isomerate.

15. A process according to claim 1, wherein the overhead effluent from the top of the distillation zone is substantially free of cyclohexane and isoparaffins with 7 carbon atoms per molecule.

16. A process according to claim 1, wherein the catalyst in the hydrogenation zone comprises at least one metal selected from the group formed by nickel and platinum.

17. A process according to claim 1, wherein the catalyst in the hydrogenation zone comprises a support.

18. A process according to claim 1, wherein the isomerisation catalyst comprises at least one metal from group VIII of the periodic classification of elements and a support comprising alumina.

19. A process according to claim 18, wherein said isomerization catalyst further comprises at least one halogen.

20. A process according to claim 18, wherein the temperature is between 80 and 300° C., the partial hydrogen pressure is between 0.1 and 70 bar, the space velocity is between 0.2 and 10 liters of liquid hydrocarbons per liters and catalyst and per hour, and the molar ratio of hydrogen to hydrocarbons in the isomerate is greater than 0.06.

21. A process according to claim 1, such that the isomerisation catalyst comprises at least one metal from group VIII of the periodic classification of elements and one zeolite.

22. A process according to claim 21, wherein said zeolite is omega mordenite.

23. A process according to claim 21, wherein the temperature is between 200 and 300° C., the partial hydrogen pressure is between 0.1 and 70 bar, the space velocity is between 0.5 and 10 liters of liquid hydrocarbons per liters of catalyst and per hour, and the molar ratio of hydrogen to hydrocarbon in the isomerate is between 0.07 and 15.

24. A process according to claims 18, wherein the group VIII metal is platinum, nickel or palladium.

25. A process according to claim 1, wherein any excess hydrogen withdrawn from the top of the distillation zone is recovered, then compressed and introduced into the hydrogenation zone.

26. A process according to claim 1, wherein any excess hydrogen withdrawn from the top of the distillation zone is recovered, then compressed and introduced into the isomerisation zone.

27. A process according to claim 1, further comprising compression stages connected to a catalytic reforming unit, and hydrogen from the top of the distillation zone is recovered, then injected upstream of the compression stages and mixed with hydrogen coming from said reforming unit.

28. A process according to claim 27, wherein said catalytic reforming unit operates at a pressure of less than 8 bar.

29. A process according to claim 1, further comprising passing a separate stream into the isomerisation zone, said separate stream comprising paraffins, a major part of which includes at least 5 carbon atoms per molecule.

* * * * *